US006722139B2

(12) United States Patent
Moon et al.

(10) Patent No.: US 6,722,139 B2
(45) Date of Patent: Apr. 20, 2004

(54) AIR CONDITIONER HAVING THERMOELECTRIC MODULE

(75) Inventors: Dong Soo Moon, Seoul (KR); Mun Kee Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 15 days.

(21) Appl. No.: 10/198,181

(22) Filed: Jul. 19, 2002

(65) Prior Publication Data

US 2003/0145605 A1 Aug. 7, 2003

(30) Foreign Application Priority Data

Feb. 7, 2002 (KR) ..... P2002-7126

(51) Int. Cl.[7] ..... F25B 21/02

(52) U.S. Cl. ..... 62/3.2

(58) Field of Search ..... 62/3.2, 3.3, 3.4, 62/3.7, 259.2

(56) References Cited

U.S. PATENT DOCUMENTS

| | | | | |
|---|---|---|---|---|
| 5,715,684 A * | 2/1998 | Watanabe et al. | ..... | 62/3.2 |
| 6,345,507 B1 * | 2/2002 | Gillen | ..... | 62/3.7 |
| 6,393,842 B2 * | 5/2002 | Kim et al. | ..... | 62/3.4 |
| 6,560,968 B2 * | 5/2003 | Ko | ..... | 62/3.2 |

* cited by examiner

*Primary Examiner*—Henry Bennett
*Assistant Examiner*—Malik N. Drake

(57) ABSTRACT

Disclosed is an air conditioner using a thermoelectric module enabling to supply users individually with fresh and pleasant air for cooling/heating. The present invention includes a thermoelectric module having high and low temperature parts discharging and absorbing heat by an electric power, a heat-absorption accelerating means connected thermally to the low temperature part of the thermoelectric module so as to accelerate heat exchange between the low temperature part and an air, and a heat-dissipation accelerating means connected to the high temperature part of the thermoelectric module to accelerate heat exchange between the high temperature part and air so as to cool the high temperature part.

30 Claims, 5 Drawing Sheets

AIR CONDITIONER HAVING THERMOELECTRIC MODULE

This application claims the benefit of the Korean Application No. P2002-7126 filed on Feb. 7, 2002, which is hereby incorporated by reference.

BACKGROUND OF THE INVENTION

1. Field of the Invention

The present invention relates to an air conditioner, and more particularly, to an air conditioner having a thermoelectric module.

2. Discussion of the Related Art

Generally, an air conditioner is an appliance installed in a room of a store, office, home, and the like so as to cool or heat a room air.

FIG. 1 illustrates a schematic diagram of a general air conditioner.

Referring to FIG. 1, an air conditioner includes a compressor 1 compressing a refrigerant, a condenser 2 condensing the compressed refrigerant, an expansion valve 3 expanding the condensed refrigerant adiabatically, and an evaporator 4 evaporating the adiabatically expanded refrigerant at an isobaric state.

Operation of the above-constructed air conditioner is schematically explained as follows.

First, a refrigerant gas compressed at high temperature and pressure in the compressor 1 is sent to the condenser 2, and then exchanges heat with an external air circulated by a blow fan 2*a* so as to be liquefied. In this case, the heat-exchanged air through the condenser 2 is discharged outside a room.

Subsequently, the refrigerant liquid having passed the condenser 2 is decompressed through the expansion valve 3 to a pressure for easy evaporation so as to be sent to the evaporator 4. The refrigerant liquid then exchanges heat with an external air circulated by the blow fan 4*a* in the evaporator 4 so as to absorb external heat.

The heat-exchanged air through the evaporator 4 is blown into a room so as to cool the room. And, the refrigerant gas having passed the evaporator 4 is sent to the compressor 1 so as to be compressed again.

Unfortunately, the general air conditioner has the following disadvantages or problems sue to its structural characteristics.

First, the air conditioner according to the related art is designed to cool an entire room space, thereby failing to satisfy all the tastes of persons in the room individually as well as efficient in an air-conditioned capacity required for cooling.

Namely, a capacity suitable for a standard quantity of human respiration is 0.1~0.15 l/s per person. A general air conditioner supplies a standard quantity of human respiration of 10 l/s per person. Thus, it is known that the quantity required for human substantially is about 1% of the entire air-conditioned quantity.

Second, the air conditioner according to the related art is a fixed type and increases in volume, whereby a cooling/heating effect is reduced in an area far from the air conditioner. Furthermore, there is no effect at all outside the room having the air conditioner inside.

SUMMARY OF THE INVENTION

Accordingly, the present invention is directed to an air conditioner using a thermoelectric module that substantially obviates one or more problems due to limitations and disadvantages of the related art.

An object of the present invention is to provide an air conditioner using a thermoelectric module enabling to supply users individually with fresh and pleasant air for cooling/heating.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an air conditioner according to the present invention includes a thermoelectric module having high and low temperature parts discharging and absorbing heat by an electric power, a heat-absorption accelerating means connected thermally to the low temperature part of the thermoelectric module so as to accelerate heat exchange between the low temperature part and an air, and a heat-dissipation accelerating means connected to the high temperature part of the thermoelectric module to accelerate heat exchange between the high temperature part and air so as to cool the high temperature part.

Accordingly, the present invention enables to supply users individually with fresh and pleasant air for cooling/heating as the air conditioner decreases in volume using the thermoelectric module.

In this case, the present invention proposes the heat-dissipation accelerating means using both air-cooling and water-cooling systems properly. Therefore, the air conditioner according to the present invention enables to cool the high temperature part more efficiently, thereby increasing a heat-exchange efficiency.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
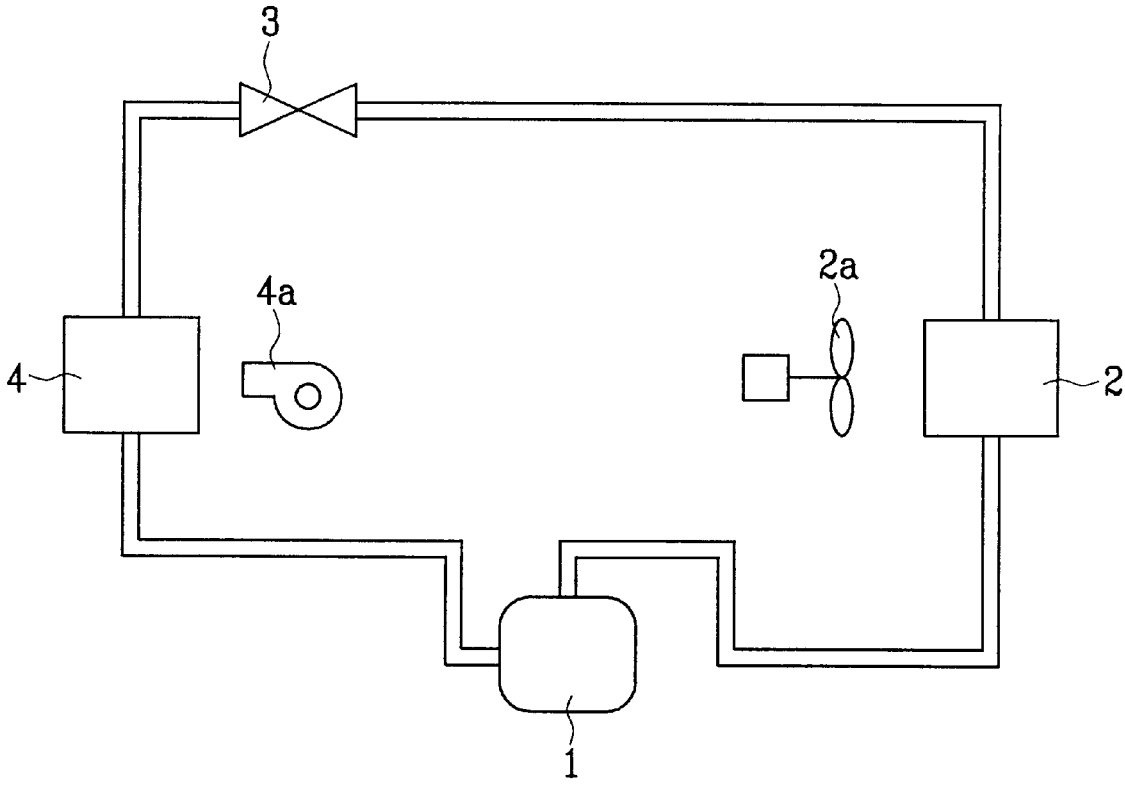
FIG.1 Prior Art
FIG. 1 illustrates a schematic diagram of a general air conditioner.
Figure 2:
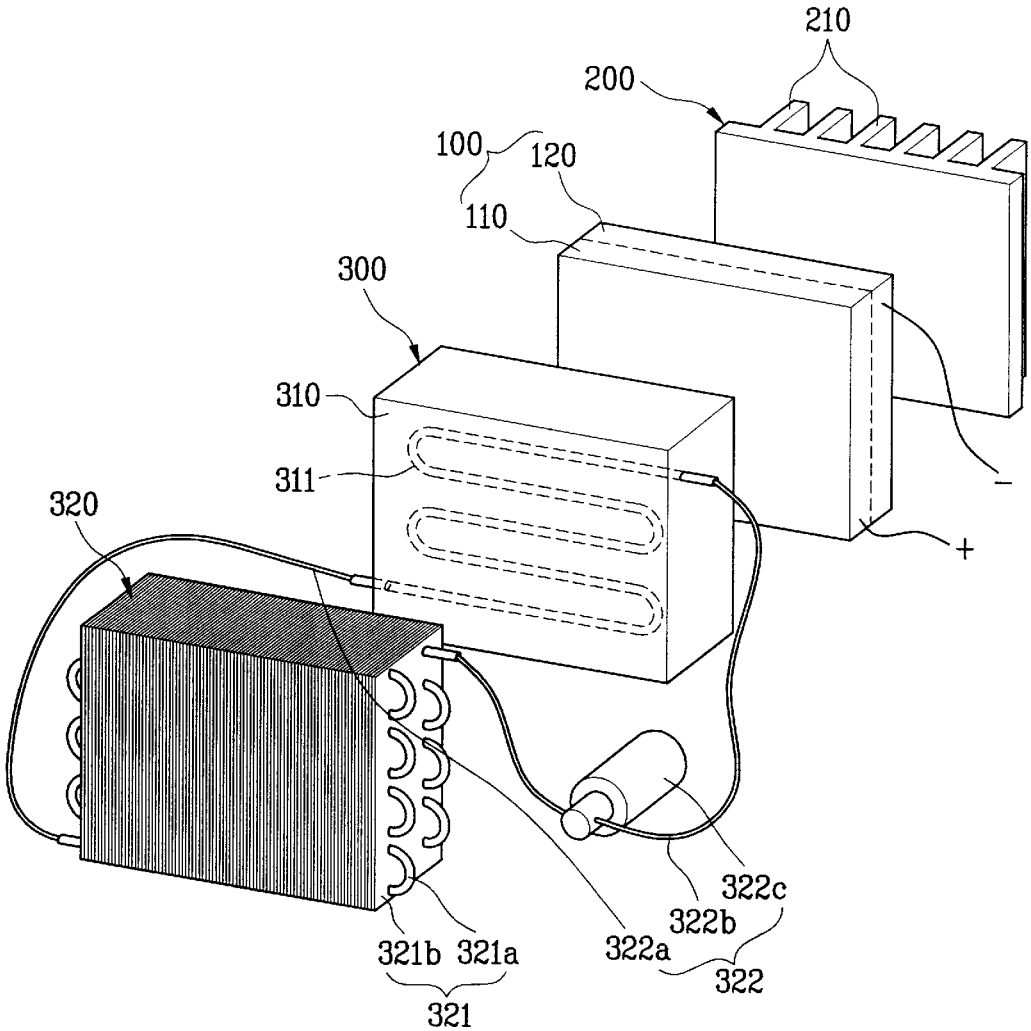
FIG. 2 illustrates a bird's-eye view of disassembled major parts of an air conditioner according to the present invention.

FIG. 2 illustrates a bird's-eye view of disassembled major parts of an air conditioner according to the present invention.

Referring to FIG. 2, an air conditioner according to the present invention includes a thermoelectric module 100 having high and low temperature parts 110 and 120 dissipating and absorbing heat, respectively by an electric power, a heat-absorption accelerating means connected thermally to the low temperature part 120 of the thermoelectric module 100 so as to accelerate heat exchange with an external air, and a heat-dissipation accelerating means connected thermally to the high temperature part 110 of the thermoelectric module 100 so as to cool the high temperature part 110 as well as accelerate heat exchange with the external air.

The thermoelectric module 100 includes n and p type thermoelectric semiconductors connected in series electrically as well as in parallel thermally reciprocally. In this case, when a DC current is applied to the thermoelectric semiconductors, endothermic and exothermic reactions occur at both sides by thermoelectric effect.

The heat-absorption accelerating means 200 includes an endothermic pin 210 contacted with the low temperature part 120 of the thermoelectric module 100 in face so as to increase a heat-exchange area with the external air and a first blow fan(not shown in the drawing) installed at a side of the endothermic pin 210 to circulate an air forcibly so as to supply a user with the heat-exchanged air.

Meanwhile, in order to improve a thermoelectric efficiency by contacting the low temperature part 120 of the thermoelectric module 100 with the endothermic pin 210 closely in face, a thermo-conductive grease (not shown in the drawing) is further included between the low temperature part 120 and endothermic pin 210 preferably.

The heat-dissipation acceleration means 300 includes a cooling chamber 310 contacted with the high temperature part 110 of the thermoelectric module 100 in face and a flow path 311 installed inside the cooling chamber 310. And, an operation fluid circulates through the flow path 311. The operation fluid is a medium exchanging heat with the high temperature part 110 of the thermoelectric module 100, and absorbs heat of the high temperature part 110. In this case, in order to improve a thermoelectric efficiency by contacting the high temperature part 110 of the thermoelectric module 100 with the cooling chamber 310 closely in face, a thermo-conductive grease (not shown in the drawing) is further included between the high temperature part 110 and cooling chamber 310 preferably.

In this case, the operation fluid preferably uses a liquid of which heat transfer quantity per unit volume is greater than that of a gas, for which there are water, ammonia, and the like. It is seen that the cooling system of the high temperature part 110 is a kind of water-cooling system. In this case, a cooling effect of the water-cooling system is superior to that of an air-cooling system, thereby enabling to improve a heat-exchange efficiency of the thermoelectric module 100.

Meanwhile, the operation fluid is naturally heated through the heat exchange with the high temperature part 110. If such an operation fluid circulates continuously, it is hardly expected that the high temperature part 110 is cooled by the operation fluid. In order to overcome this problem, a heat-exchange accelerating unit 320 connected to the flow path of the cooling chamber 310 is further included so as to discharge the heat of the operation fluid through heat exchange with air.

The heat-exchange accelerating unit 320 includes a heat exchanger 321 constructed with a tube 321*a* through which the operation fluid flows and heat-dissipating pins 321*b* extending a heat-exchange area, a operation fluid circulation part 322 circulating the operation fluid of the cooling chamber 310 to the heat exchanger 321 by connecting the flow path 311 of the cooling chamber to the tube 321*a* of the heat exchanger, and a second blow fan(not shown in the drawing) installed at a side of the heat exchanger 321 so as to circulate an air forcibly.

The operation fluid circulation part 322 includes a first connecting pipe 322*a* connecting one end of the flow path 311 to one end of the tube 321*a* reciprocally, a second connecting pipe 322*b* connecting the other end of the flow path 311 to the other end of the tube 321*a* reciprocally, and a pump 322*c* connected to one of the first and second connecting pipes 322*a* and 322*b* so as to circulate the operation fluid of the flow path 311 forcibly. In this case, the first and second connecting pipes 322*a* and 322*b* are preferably made of flexible material so as to leave the heat exchanger 321 and cooling chamber 310 apart reciprocally.

The above-constructed air conditioner can be embodied as follows.

Figure 3:
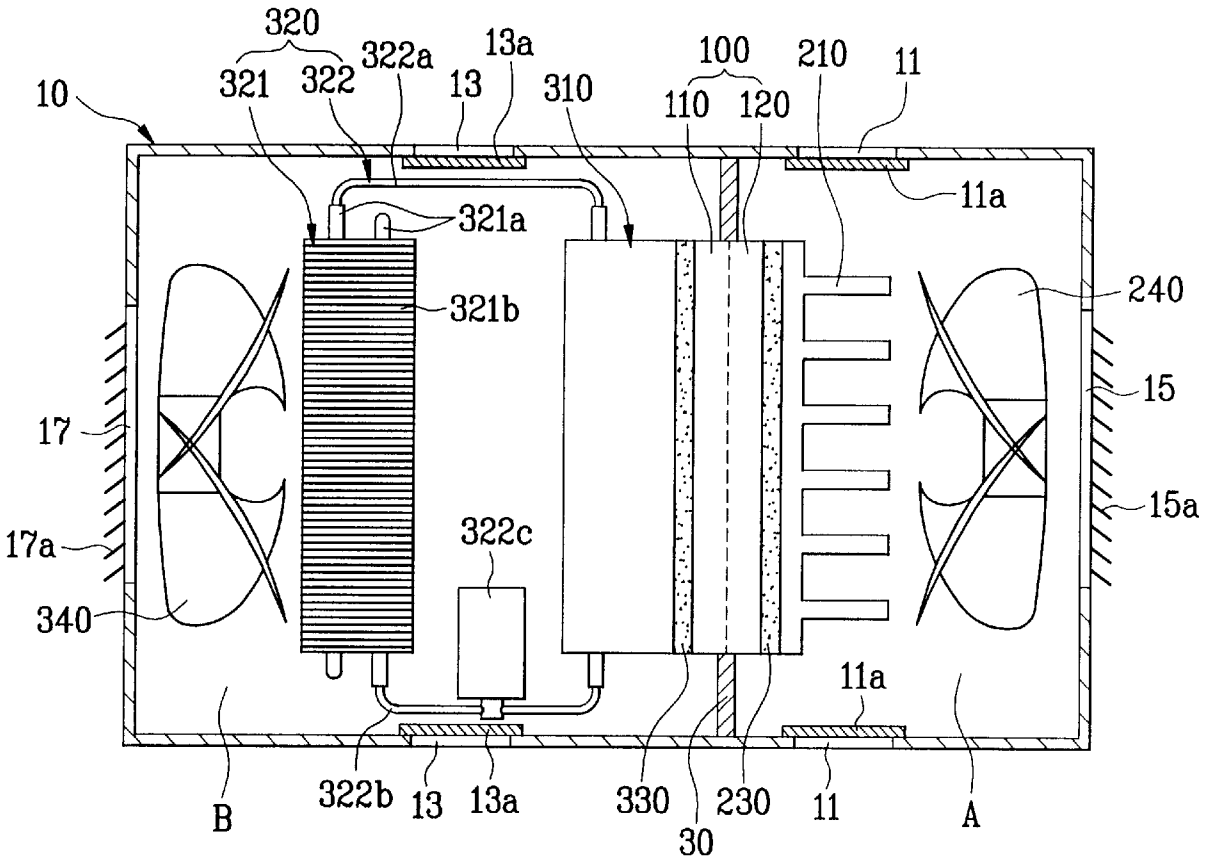
FIG. 3 illustrates a cross-sectional view of an air conditioner according to an embodiment of the present invention.

First, FIG. 3 illustrates a cross-sectional view of an air conditioner according to an embodiment of the present invention, in which the thermoelectric module 100, the heat-absorption accelerating means 200 and the heat-dissipation accelerating means 300 are installed in one case.

Referring to FIG. 3, an air conditioner according to an embodiment of the present invention includes a case 10, a thermoelectric module 100 installed inside the case 10 and having a high temperature part 110 discharging heat by an electric power and a low temperature part 120 absorbing heat, an adiabatic plate 30 partitioning an inner space of the case 10 into a heat-dissipation part B including the high temperature part 110 of the thermoelectric module and a heat-absorption part A including the low temperature part 120 of the thermoelectric module, a heat-absorption accelerating means installed at the heat-absorption part A, and a heat-dissipation accelerating means installed at the heat-dissipation part B.

First intake port 11 and blow outlet 15 are formed at a side of the heat-absorption part A of the case 10, while second intake port 13 and blow outlet 17 through which a heat-dissipation air passes are formed at a side of the heat-dissipation part B of the case B.

At the heat-absorption part A of the case 10, installed are heat-absorption pins 210 contacted in face with the low temperature part 120 of the thermoelectric module and a first blow fan 240 circulating forcibly an air exchanging heat with the low temperature part 120 of the thermoelectric module through the heat-absorption pins. In this case, a thermo-conductive grease is formed between the low temperature part 120 and heat-absorption pins 210.

At the heat-dissipation part B of the case, installed are a cooling chamber 310 contacted in face with the high temperature part 110 of the thermoelectric module and having an operation fluid flow inside for heat exchange, a heat-exchange accelerating unit 320 connected to the cooling chamber so as to cool the operation fluid, which is hot through heat exchange, through heat-exchange with an air, and a second blow fan 340 circulating the air forcibly so as to cool the operation fluid circulating the heat-exchange accelerating unit. In this case, the operation fluid is a kind of liquid of which heat-transfer quantity per unit volume is greater than that of the air, preferably such as water, ammonia, or the like.

Meanwhile, a thermo-conductive grease 330 is preferably included between the high temperature part 110 and cooling chamber 310.

The heat-exchange accelerating unit 320, as mentioned in the foregoing description, includes a heat exchanger 321 constructed with a tube 321 through which the operation fluid circulates and heat-dissipation pins 321 exchanging heat with the air. In this case, connecting pipes 322*a* and 322*b* connecting a fluid path of the cooling chamber and the tube 321*a* of the heat exchanger are installed between the heat exchanger 321 and cooling chamber 310. And, a pump 322*c* circulating the operation fluid forcibly is installed on the connecting pipes 322*a* and 322*b*.

In this case, filters 11*a* and 13*a* filtering particles or contaminants in the sucked-in air are preferably installed at the first and second intake ports 11 and 13, respectively. Moreover, wind-direction guides 15*a* and 17*a* are preferably installed at the first and second blow outlets 15 and 17, respectively so as to change a blow direction of the blown air.

The above-constructed air conditioner can be applied to a cooler or heater for the purpose of air conditioning.

Namely, the air conditioner is installed for a cooling condition in a room in a manner that a room air circulates through the first intake port 11 and blow outlet 15 and that an outdoor air circulates through the second intake port 13 and blow outlet 17. On the contrary, the air conditioner is installed for a heating condition in a room in a manner that the outdoor air circulates through the first intake port 11 and blow outlet 15 and that the room air circulates through the second intake port 13 and blow outlet 17.

The operation for the use of the air conditioner as a cooler is explained in detail as follows.

First, a DC power is applied to the thermoelectric module 100, and the pump 322*c* and the first and second blow fans 240 and 340 are driven. Then, a room air is sucked into the heat-absorption part A of the case by the first blow fan 240 through the first intake port 11. Subsequently, the room air passes the heat-absorption pins 210 to exchange heat with the low temperature part 120 of the thermoelectric module so as to be cooled. Thereafter, the cooled room air by the heat exchange is blown into the room through the first blow outlet 15 so as to supply a user with cool air.

In this case, the room air sucked inside the case through the first intake port 11 passes the filter 11*a* so as to be purified. And, the room air blown through the first blow outlet 15 is guided by the wind-direction guide 15*a* so as to be intensively supplied to a user's demanding specific place.

At the same time, the outdoor air is sucked into the heat-dissipation part B of the case 10 by the second blow fan 340 through the second intake port 13. And, the outdoor air passes the heat exchanger 321 to exchange heat with the operation fluid so as to be heated at a high temperature. The outdoor air heated by the heat exchange is discharged outside the room through the second blow outlet 17.

During such a process, the operation fluid passing the cooling chamber 310 exchanges heat with the high temperature part 110 of the thermoelectric module so as to cool the high temperature part. And, the operation fluid enters the heat exchanger 321 through the first connecting pipe 322*a*. The operation fluid passes the heat exchanger 321 to exchange heat with the outdoor air so as to be cooled again, and then enters the cooling chamber 310 through the second connecting pipe 322*b* so as to cool the high temperature part 110 of the thermoelectric module. Such a circulation of the operation fluid is repeated by the operation of the pump 322*c*.

When the air conditioner is used as a heater, the room air of which temperature increases high through the heat exchanger 321 is blown in the room through the second blow outlet 17. In this case, the room air sucked into the case 10 through the second intake port 13 passes the filter 13*a* to be purified, and the room air blown through the second blow outlet 17 is guided by the wind-direction guide 17*a* so as to be supplied intensively to a user demanding specific place.

Therefore, the air conditioner according to the present invention uses the thermoelectric module 100, thereby enabling to supply a user in the room with a pleasant cool/hot airflow individually as well as cool the high temperature part 110 of the thermoelectric module effectively.

Figure 4A:
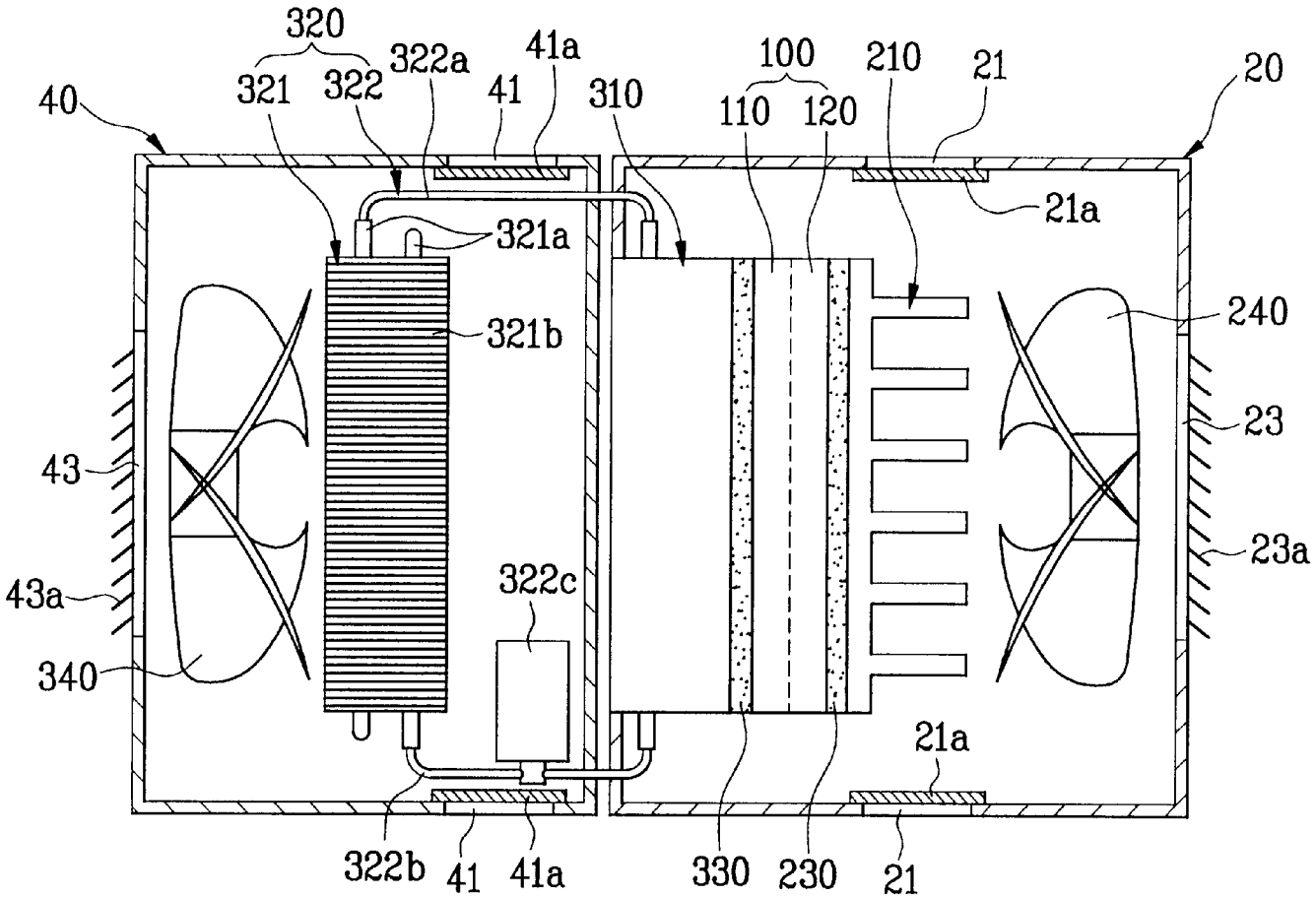
FIG. 4A illustrates a cross-sectional view of an air conditioner according to another embodiment of the present invention.

FIG. 4A illustrates a cross-sectional view of an air conditioner according to another embodiment of the present invention, in which a cooling chamber of the heat-dissipation accelerating means and a heat-exchange accelerating means are installed separately in a case.

Referring to FIG. 4A, an air conditioner according to a second embodiment of the present invention includes a heat-absorption case 20 having a first intake port 21 at one side for air inflow and a first blow outlet 23 at the other side for an outflow of heat-exchanged air and a heat-dissipation case 40 having a second intake port 41 for air inflow and a second blow outlet 43 at the other side for outflow of heat-exchanged air.

In the heat-absorption case 20, installed are a thermoelectric module 100 having a high temperature part 110 discharging heat by an electric power and a low temperature part 120 absorbing heat, heat-absorption pins 210 contacted in face with the low temperature part 120 of the thermoelectric module, a first blow fan 240 circulating forcibly an air through the first intake port 21 and blow outlet 23 for heat exchange with the heat-absorption pins, and a cooling chamber 310, through which an operation fluid flows for heat exchange, contacted in face with the high temperature part 110 of the thermoelectric module. In this case, thermo-conductive greases 230 and 330 are included between the low temperature part 120 and heat-absorption pins 210 and between the high temperature part 110 and cooling chamber 310, respectively.

In the heat-dissipation case 40, installed are a heat-exchange accelerating unit 320 connected to the cooling chamber 310 so as to cool the operation fluid, which has been hot through heat exchange, through heat exchange with the air and a second blow fan 340 circulating the air forcibly through the second intake port 41 and blow outlet 43 for heat exchange with the operation fluid circulating the heat-exchange accelerating unit. In this case, the heat-exchange accelerating unit 320 includes a heat exchanger 321 having a tube 321 through which the operation fluid circulates and heat-dissipation pins 321*b* exchanging heat with the air.

The operation fluid, as mentioned in the foregoing description, consists of a liquid of which heat-transfer quantity per unit volume is greater than that of air such as water, ammonia, or the like.

In order to make the operation fluid circulate between the cooling chamber 310 and heat exchanger 321, a plurality of connecting pipes 322*a* and 322*b* are installed between the heat-absorption and heat-dissipation cases 20 and 40. The connecting pipes include a first connecting pipe 322*a* connecting one end of a flow path of the cooling chamber 310 to one end of the tube 321*a* and a second connecting pipe 322*b* connecting the other end of the flow path to the other end of the tube 321*a*. In this case, the first and second connecting pipes 322*a* and 322*b* are preferably made of a flexible material for easy and free installment of the heat-absorption and heat-dissipation cases 40.

In this case, a pump 322*c* circulating the operation fluid forcibly is installed on the connecting pipe located inside the heat-dissipation case 40.

Preferably, filters 21*a* and 41*a* are installed at the first and second intake ports 21 and 41 so as to filter particles or contaminants in the sucked-in air, and wind-direction guides 23*a* and 43*a* are installed at the first and second blow outlets 23 and 43 so as to change a direction of the blown air freely.

Figure 4B:
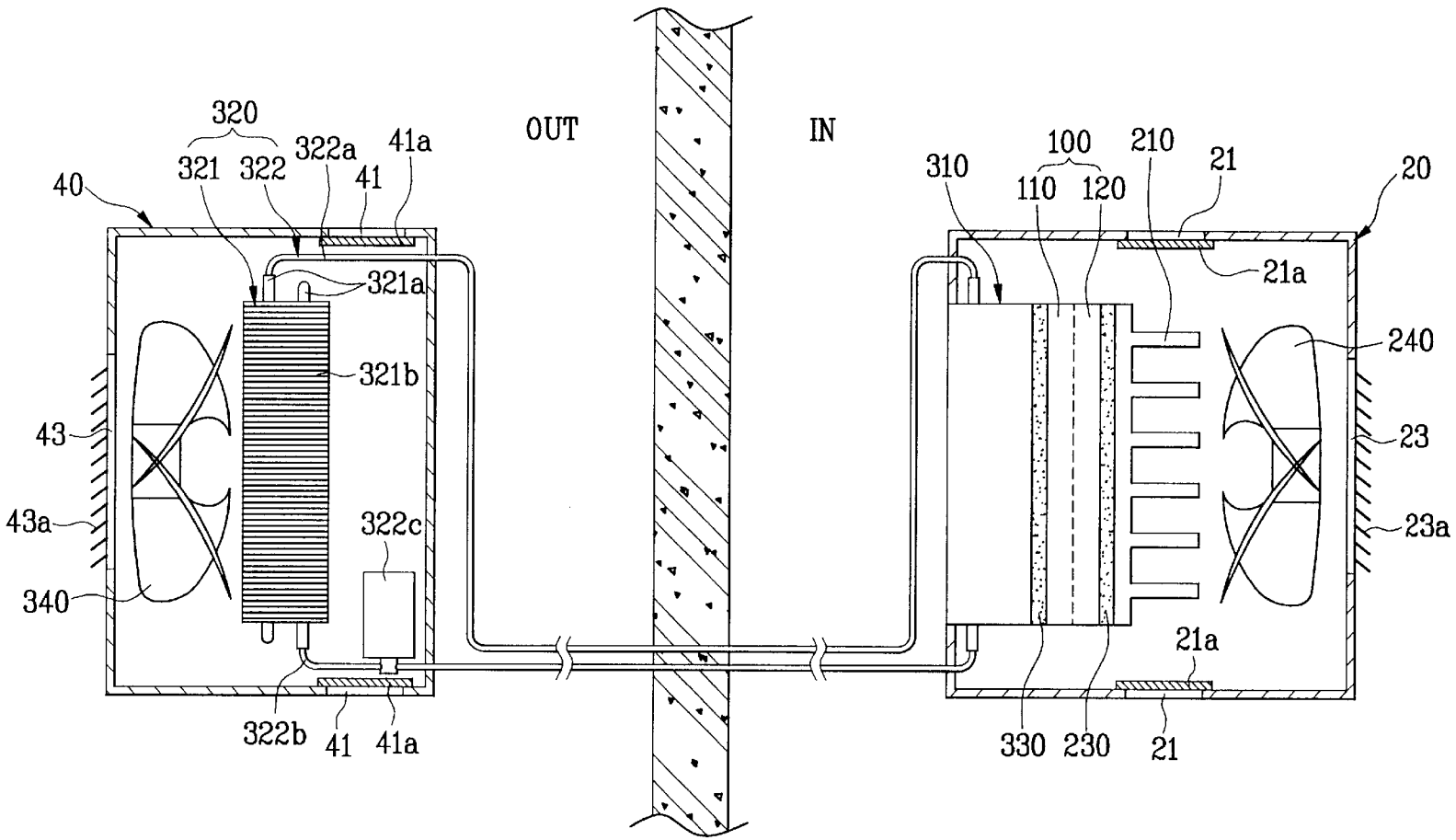
FIG. 4B illustrates a cross-sectional view of the air conditioner in FIG. 4A which is installed in another way.

The heat-absorption and heat-dissipation cases 20 and 40 of the above-constructed air conditioner are detachable from each other by an additional detaching means, or can be used separately as shown in FIG. 4B.

FIG. 4B illustrates a cross-sectional view of the air conditioner, which is installed in another way, in FIG. 4A.

Referring to FIG. 4B, the heat-absorption and heat-dissipation cases 20 and 40 are installed separately using the connecting pipes 322*a* and 322*b* as media. In this case, for the purpose of a room air conditioning, one of the heat-absorption and heat-dissipation cases 20 and 40 is randomly installed in the room, while the rest is installed outside. Namely, in order to cool the room, the heat-absorption case 20 is installed in the room and the heat-dissipation case 40 is installed at outdoor. On the contrary, for heating the room, the heat-absorption case 20 is installed at outdoor and the heat-dissipation case 40 is installed in the room.

It is shown in FIG. 4B that the heat-absorption case 20 is installed in the room and the heat-dissipation case 40 is installed at outdoor. In this case, since the flexible connecting pipes 322*a* and 322*b* are installed between the heat-absorption and heat-dissipation cases 20 and 40, it is easy to install the heat-absorption and heat-dissipation cases 20 and 40 separately.

The operation of the air conditioner according to the second embodiment of the present invention is as good as that shown in FIG. 3, which is skipped hereinafter.

As mentioned in the foregoing description, the air conditioner according to the present invention has the following advantages or effects.

First, the present invention uses a small type thermoelectric operating electrically as a heating/cooling means, thereby enabling to be portable with ease as well as make its size versatile. Therefore, it is easy to install the air conditioner according to the present invention at a user-demanding specific place, whereby the present invention provides the user's surroundings with cool/hot air intensively so as to improve a user's satisfaction.

Second, the present invention cools the high temperature part of the thermoelectric module effectively, thereby enabling to improve a heat exchange efficiency. Therefore, the present invention prevents previously the breakage or damage of the thermoelectric module caused by the excessive increase of temperature at the high temperature part, thereby enabling to extend an endurance of a product.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. An air conditioner comprising:

a thermoelectric module having a high temperature part discharging heat and a low temperature part absorbing heat by an electric power;

a heat-absorption accelerating means connected thermally to the low temperature part of the thermoelectric module so as to accelerate heat exchange between the low temperature part and an air, wherein said; and a heat-dissipation accelerating means connected thermally to the high temperature part of the thermoelectric module to accelerate heat exchange between the high temperature part and air so as to cool the high temperature part, wherein said the heat-dissipation accelerating means further includes a cooling chamber in face to face contact with the high temperature part of the thermoelectric module, a flow path installed inside the cooling chamber absorbing heat of the high temperature part, wherein an operation fluid circulates through the flow path, and a heat-exchange accelerating unit connected to the flow path of the cooling chamber so as to cool the operation fluid through heat exchange with the air, the heat-exchange accelerating unit further including a heat exchanger having a tube in which the operation fluid circulates and a heat-dissipation pin exchanging heat with the air, an operation fluid circulation part connecting the flow path of the cooling chamber to the tube of the heat exchanger so as to circulate the operation fluid, and a second blow fan installed at a side of the heat exchanger so as to circulate an external air forcibly for heat exchange.

2. The air conditioner of claim 1, the heat-absorption accelerating means comprising:

a heat-absorption pin in face to face contact with the low temperature part of the thermoelectric module; and a first blow fan installed at a side of the heat-absorption pin so as to circulate the air forcibly for heat exchange.

3. The air conditioner of claim 2, the heat-absorption accelerating means further comprising a thermo-conductive grease between the low temperature part of the thermoelectric module and heat-absorption pin so as to contact the low temperature part in close face to face contact with the heat-absorption pin.

4. The air conditioner of claim 1, the heat-dissipation accelerating means further comprising a thermo-conductive grease between the high temperature part of the thermoelectric module and the cooling chamber so as to closely contact the high temperature part in contact with the cooling chamber.

5. The air conditioner of claim 1, wherein the operation fluid is a liquid of which heat-transfer quantity per unit volume is greater than that of the air.

6. The air conditioner of claim 5, wherein the operation fluid consists of one of water and ammonia.

7. The air conditioner of claim 1, the operation fluid circulation part comprising:

a connecting pipe connecting the flow path of the cooling chamber to the tube of the heat exchanger; and a pump installed on the connecting pipe so as to circulate the operation fluid forcibly.

8. The air conditioner of claim 7, wherein the connecting pipe is made of a flexible material so as to leave the cooling chamber apart from the heat exchanger.

9. An air conditioner comprising:

a case having first intake port and blow outlet through which a heat-absorption air passes and second intake port and blow outlet through which a heat-dissipation air passes;

a thermoelectric module installed in the case and having high and low temperature parts discharging and absorbing heat by an electric power, respectively;

a heat-insulating plate partitioning an inner space of the case into a heat-dissipation part including the high temperature part of the thermoelectric module and a heat-absorption part including the low temperature part of the thermoelectric module;

a heat-absorption pin installed in the heat-absorption part of the case so as to be in face to face contact with the low temperature part of the thermoelectric module;

a first blow fan installed in the heat-absorption part of the case so as to circulate an air forcibly through the first intake port and blow outlet for heat exchange;

a cooling chamber installed in the heat-dissipation part of the case and in face to face contact with the high temperature part of the thermoelectric module wherein an operation fluid flows in the cooling chamber for heat exchange;

a heat-exchange accelerating unit installed in the heat-dissipation part of the case and connected to the cooling chamber so as to cool the operation fluid, which is heated hot by the heat exchange, through heat exchange with the air; and a second blow fan installed in the heat-dissipation part so as to circulate the air forcibly through the second intake port and blow outlet.

10. The air conditioner of claim 9, further comprising a thermo-conductive grease between the low temperature part of the thermoelectric module and heat-absorption pin so as to contact the low temperature part in close face to face contact with the heat-absorption pin.

11. The air conditioner of claim 9, further comprising a thermo-conductive grease between the high temperature part of the thermoelectric module and the cooling chamber so as to contact the high temperature part in close face to face contact with the cooling chamber.

12. The air conditioner of claim 9, wherein the operation fluid is a liquid of which heat-transfer quantity per unit volume is greater than that of the air.

13. The air conditioner of claim 12, wherein the operation fluid consists of one of water and ammonia.

14. The air conditioner of claim 9, wherein the heat-exchange accelerating unit is a heat exchanger comprising a tube in which the operation fluid circulates and a heat-dissipation pin exchanging heat with the air.

15. The air conditioner of claim 9, further comprising a pump installed between the cooling chamber and heat-exchange accelerating unit so as to circulate the operation fluid forcibly.

16. The air conditioner of claim 9, further comprising filters installed at the first and second intake ports so as to filter contaminants in the air.

17. The air conditioner of claim 9, further comprising wind-direction guides installed at the first and second blow outlets so as to change a wind direction of the blown air freely.

18. The air conditioner of claim 9, wherein a room air circulates through the first intake port and blow outlet and an outdoor air circulates through the second intake port and blow outlet for cooling a room.

19. The air conditioner of claim 9, wherein an outdoor air circulates through the first intake port and blow outlet and a room air circulates through the second intake port and blow outlet for heating a room.

20. An air conditioner comprising:

a heat-absorption case having a first intake port at one side to suck air in and a first blow outlet at the other side to blow out a heat-exchanged air;

a thermoelectric module installed in the heat-absorption case and having high and low temperature parts discharging and absorbing heat by an electric power, respectively;

a heat-absorption pin installed in the heat-absorption case so as to be in face to face contact with the low temperature part of the thermoelectric module;

a first blow fan installed in the heat-absorption case so as to circulate an air forcibly through the first intake port and blow outlet for heat exchange;

a cooling chamber installed in the heat-absorption case and in face to face contact with the high temperature part of the thermoelectric module wherein an operation fluid flows in the cooling chamber for heat exchange;

a heat-dissipation case having a second intake port at one side to suck air in and a second blow outlet at the other side to blow out a heat-exchanged air;

a heat-exchange accelerating unit installed in the heat-dissipation case and connected to the cooling chamber so as to cool the operation fluid, which is heated hot by the heat exchange, through heat exchange with the air;

a second blow fan installed in the heat-dissipation case so as to circulate the air forcibly through the second intake port and blow outlet; and a connecting pipe installed between the cooling chamber and heat-exchange accelerating unit so as to form a circulation fluid path of the operation fluid.

21. The air conditioner of claim 20, further comprising thermo-conductive greases between the low temperature part of the thermoelectric module and heat-absorption pin and between the high temperature part of the thermoelectric module and the cooling chamber so as to contact the low temperature part in close face to face contact with the heat-absorption pin and the high temperature part in close face to face contact with the cooling chamber, respectively.

22. The air conditioner of claim 20, wherein the operation fluid is a liquid of which heat-transfer quantity per unit volume is greater than that of the air.

23. The air conditioner of claim 22, wherein the operation fluid consists of one of water and ammonia.

24. The air conditioner of claim 20, wherein the heat-exchange accelerating unit is a heat exchanger comprising a tube in which the operation fluid circulates and a heat-dissipation pin exchanging heat with the air.

25. The air conditioner of claim 20, further comprising a pump installed on the connecting pipe in the heat-dissipation case so as to circulate the operation fluid forcibly.

26. The air conditioner of claim 20, further comprising filters installed at the first and second intake ports so as to filter contaminants in the air.

27. The air conditioner of claim 20, further comprising wind-direction guides installed at the first and second blow outlets so as to change a wind direction of the blown air freely.

28. The air conditioner of claim 20, wherein the connecting pipe is made of a flexible material so as to install the heat-absorption and heat-dissipation cases freely.

29. The air conditioner of claim 20, wherein the heat-absorption and heat-dissipation cases are installed inside and outside a room, respectively for cooling the room.

30. The air conditioner of claim 22, wherein the heat-absorption and heat-dissipation cases are installed outside and inside a room, respectively for heating the room.

* * * * *